United States Patent [19]

Reichert et al.

[11] Patent Number: 4,902,408

[45] Date of Patent: Feb. 20, 1990

[54] PROCESS FOR REMOVING HYDROGEN SULPHIDE USING METAL COMPOUNDS

[75] Inventors: Günther Reichert; Christian Wegner, both of Cologne, Fed. Rep. of Germany

[73] Assignee: Bayer Aktiengesellschaft, Leverkusen, Fed. Rep. of Germany

[21] Appl. No.: 224,972

[22] Filed: Jul. 27, 1988

[30] Foreign Application Priority Data

Aug. 13, 1987 [DE] Fed. Rep. of Germany ..... 3726917

[51] Int. Cl.[4] ..... C10G 29/00

[52] U.S. Cl. ..... 208/239; 208/243; 208/244; 208/247; 210/729; 210/730; 210/916; 423/226

[58] Field of Search ..... 423/226; 210/729, 730, 210/DIG. 916; 208/239, 243, 244, 247

[56] References Cited

U.S. PATENT DOCUMENTS

| | | | |
|---|---|---|---|
| 1,740,584 | 12/1929 | Gardner et al. | 208/239 |
| 2,080,087 | 5/1937 | Mizuta et al. | 208/239 |
| 2,467,429 | 4/1949 | Hoover | 208/239 |
| 2,496,536 | 2/1950 | Hoover | 208/239 |
| 2,641,571 | 6/1953 | Leutz | 208/240 |
| 3,956,473 | 5/1976 | Mimoun et al. | 423/226 |
| 4,283,379 | 8/1981 | Fenton et al. | 423/226 |
| 4,325,936 | 4/1982 | Gowdy et al. | 423/226 |
| 4,432,962 | 2/1984 | Gowdy et al. | 423/226 |
| 4,569,766 | 2/1986 | Koo et al. | 210/690 |
| 4,585,751 | 4/1986 | Kukes et al. | 208/243 |
| 4,596,654 | 6/1986 | Kukes et al. | 208/244 |
| 4,708,784 | 11/1987 | Howell et al. | 208/243 |

FOREIGN PATENT DOCUMENTS

| | | | |
|---|---|---|---|
| 191037 | 6/1924 | United Kingdom . | |
| 1305718 | 2/1973 | United Kingdom | 423/226 |

*Primary Examiner*—Robert L. Stoll
*Assistant Examiner*—Lori F. Cuomo
*Attorney, Agent, or Firm*—Sprung Horn Kramer & Woods

[57] ABSTRACT

Hydrogen sulphide is removed using transition metal carboxylates.

3 Claims, No Drawings

PROCESS FOR REMOVING HYDROGEN SULPHIDE USING METAL COMPOUNDS

The present invention relates to the removal of hydrogen sulphide using transition metal compounds.

Hydrogen sulphide is frequently undesirable due to its toxicity, its corrosive properties and its disagreeable odour. Thus, the maximum acceptable concentration at work sites is only 10 ppm (=MAC value). In addition, the specification for many petrochemical products requires that hydrogen sulphide may be present in them at a maximum level of a few ppm.

It is known that hydrogen sulphide can be removed with certain iron oxides (see, for example, U.S. Pat. Nos. 4,008,775 and 4,476,027). This process requires relatively large amounts of iron oxides and relatively long contact times. In addition, the reaction products of hydrogen sulphide with iron oxides are obtained as solid particles. This method of removing hydrogen sulphide is therefore essentially only of interest in locations where these disadvantages are not disruptive, for example in drilling holes in the search for and recovery of oil and/ or natural gas.

In the processing of oil and oil products in refineries or petrochemical plants, hydrogen sulphide must often be removed from condensed gases and/or liquid products and streams. Even if hydrogen sulphide is present in high dilution, the requirements are for the use of a small number of auxiliaries, short reaction times and easy handling (e.g. good metering capability and prevention of sedimentations) in combination with virtually complete removal of hydrogen sulphide. This object has not yet been achieved in a satisfactory manner.

It is true that the use of chlorine dioxide or acrolein for this purpose is known (see ASTM STP 641), but these are toxic substances whose handling requires special equipment. Moreover, chlorine dioxide is very corrosive and is of low efficiency in the case of low hydrogen sulphide contents and/or high oil, especially paraffin, contents in the substrate to be treated. Amines have also been suggested for this purpose (see Oil and Gas Journal, Sept. 29 (1986), p. 61–65). However, these must be preconditioned with strong alkalis, which themselves are corrosive, and are also of low efficiency in substrates with high oil contents. The same is true for the use of aqueous manganese(II) sulphate solutions and of acrylamides (see DE-OS (German Published Specification) No. 2,710,529). In the case of the latter, the presence of alkaline catalysts is also necessary. Finally, the use of maleic imides (see U.S. Pat. No. 4,569,766) and N-halosulphonamides (see U.S. Pat. Specification No. 4,374,732) is also unsatisfactory, especially because the reaction products are difficult to remove therefrom.

A process for removing hydrogen sulphide has now been found, which is characterized in that the hydrogen sulphide to be removed is brought into contact with a transition metal carboxylate.

Suitable examples of the process according to the invention are carboxylates of titanium, vanadium, chromium, iron, cobalt, nickel, copper, zinc and/or manganese, it being possible for the transition metals to be present in all common oxidation numbers. Preference is given to carboxylates of the di- or trivalent iron and the divalent manganese.

The carboxylates can be those which are derived from mono-, di- or polycarboxylic acids. The carboxylate radicals can contain, for example, 2 to 20 C atoms and 1 to 3 carboxylate groups. The carbon skeleton of the carboxylate radicals can be, for example, straight-chain, branched or cyclic. Preferably the carboxylate radical is derived from carboxylic acids whose transition metal salts are very soluble in unpolar solvents, for example in aliphatic and aromatic hydrocarbons. Examples which may be mentioned are: oleic acid, tall oil fatty acid, linoleic acid, linolenic acid and ricinoleic acid. Particular preference is given to straight-chain or branched $C_4$–$C_{14}$-acids such as, for example, coconut acid or Versatic acids. Especially preferred are octanoate radicals such as 2-ethylhexanoate. It goes without saying that it is possible to use mixtures of different transition metal carboxylates also which can differ with respect to the transition metal and/or carboxylate radical.

Using the process according to the invention, hydrogen sulphide can be removed from a wide range of (undesirable) sources. It is particularly suitable for removing hydrogen sulphide from mineral oil-containing liquids or from liquids which are to be processed in refineries or petrochemical plants or have been produced there. It is also very suitable for removing hydrogen sulphide from condensed gases, for example from condensed, very volatile hydrocarbons and mixtures of hydrocarbons. The process according to the invention is particularly advantageously used to remove hydrogen sulphide from liquids having high contents of aromatic and/or paraffinic components. For example, these contents can amount to more than 60% by weight, preferably they are 70 to 100% by weight.

The transition metal carboxylates can be used in the context of the present invention in the form in which they are present or in which they are after they have been prepared. In general, they are viscous liquids. Preferably, the transition metal carboxylates are used as a solution or dispersion in a hydrocarbon (e.g. benzene or xylene) or a mixture of hydrocarbons (e.g. petrol or petroleum). In this case, they are less viscous, and can be dispersed even more easily in the liquids which are preferably freed of hydrogen sulphide, and they are more easily meterable.

The concentration of the transition metal carboxylates in hydrocarbons or mixtures of hydrocarbons can be whatever is desired. Suitable are for example concentrations of 0.1 to 10% by weight.

Those transition metal carboxylates to be used for the process according to the invention which are not available commercially can be prepared in a simple manner. For example, the procedure can be such that a mixture of alkalis (e.g. NaOH) and water is neutralized by adding an equivalent amount of the desired carboxylic acid and then a preferably water-soluble mineral acid salt of the desired transition metal is added. The transition metal carboxylate formed separates as an oily layer and can be separated off as such. The last step can also be carried out in the presence of a hydrocarbon or a mixture of hydrocarbons. In this case, a solution or dispersion of the transition metal carboxylate in the hydrocarbon or the mixture of hydrocarbons is obtained which can be directly used in this form for removing the hydrogen sulphide according to the invention.

The process according to the invention has a number of surprising advantages. Hydrogen sulphide is removed even at low concentrations rapidly and completely, particularly from mixtures of hydrocarbons which are high in aromatics and/or paraffins, from which hydrogen sulphide removal had been difficult up to now. The transition metal carboxylates are of low corrosivity, do not cause any toxicological problems during their preparation, storage and handling and do not require any special equipment. The reaction products of transition metal carboxylates with hydrogen sulphide are obtained in finely dispersed form so that liquids containing them can easily be handled (e.g. pumped). The reaction products of transition metal carboxylates and hydrogen sulphide must therefore not be separated immediately after they are formed; this can be done in a suitable location, even at a distance from the place of origin, for example by fine filtration. Good results, i.e. complete removal of hydrogen sulphide within a short period of time, are even obtained, if an equivalent amount of transition metal carboxylate is used per amount of hydrogen sulphide to be separated off is used. However, in general, to be on the safe side, an excess of transition metal carboxylate is used, for example 1.1 to 5 times the amount by weight which is required arithmetically to remove all of the hydrogen sulphide present.

The present invention also relates to the use of the transition metal carboxylates described above for removing hydrogen sulphide in particular from mineral oil-containing liquids or from liquids which are to be processed in refineries or petrochemical plants or have been produced there.

EXAMPLES

A. Examples concerning the preparation of transition metal carboxylates (not part of the invention)

EXAMPLE 1

200 ml of water were placed in a beaker, 0.6 mol of NaOH was added and 0.6 mol of 2-ethylhexanoic acid was metered in. 100 ml of xylene were then added with gentle stirring. Finally, 0.1 mol of $Fe_2(SO_4)_3$, dissolved in 100 mL of water, was then stirred in. Within a few minutes a quantitative reaction took place to give iron-(III) 2-ethylhexanoate which moved to the xylene layer and was separated together with the xylene from the reaction mixture.

EXAMPLE 2

The procedure of Example 1 was repeated with the exception that instead of xylene 100 ml of a paraffin oil low in aromatics (commercial name: Shellsol® D 70) were added.

Example 3

0.1 mol of 2-ethylhexanoic acid was mixed with 100 ml of water, and 0.1 mol of NaOH was added to this mixture. 100 ml of xylene and finally 0.05 mol of $MnSO_4 \times 2H_2O$, dissolved in 100 ml of water, were then added. The xylene layer which contained the manganese(II)- 2-ethylhexanoate formed was separated off.

B. Examples concerning the removal of hydrogen sulphide (according to the invention)

The following examples were performed in a laboratory and simulate the conditions in a petrochemical plant as realistically as possible.

EXAMPLE 4

500 ml of xylene were placed in a flask at room temperature, and hydrogen sulphide was introduced until it was present in the xylene in a concentration of 2640 ppm. Using a syringe, 23 ml (25.8 mmol) of the dispersion of iron-(III) 2-ethylhexanoate in xylene, which had been obtained according to Example 1, were then added. Immediately, a precipitate of iron sulphide formed. The mixture was then filtered, the filtrate was tested for hydrogen sulphide and no more hydrogen sulphide was found.

EXAMPLE 5

229 g of a 60% strength dispersion of iron(III)-2-ethylhexanoate in xylene were mixed in a 12 l autoclave at room temperature with 600 ml of xylene. 10 ml of liquid hydrogen sulphide were then metered in. Subsequently, nitrogen was injected in such an amount that a pressure of 5 bar was reached. After 15 minutes, a sample was removed from the autoclave. In it, no more hydrogen sulphide could be detected.

EXAMPLE 6

The procedure of Example 5 was repeated with the exception that the appropriate amount of manganese-(II)-2-ethylhexanoate was used. In this case too, no more hydrogen sulphide could be detected after 15 minutes.

EXAMPLE 7

229 g of a 60% strength solution of iron-(III)-2-ethylhexanoate in xylene were introduced together with 6 l of a mixture of 10% by volume of xylene and 90 % by volume of petroleum p.a. (from Merck, Darmstadt, maximum aromatics content 0.2%) into a 12 l autoclave. 10 ml of liquid hydrogen sulphide were then added. Subsequently, nitrogen was injected up to a pressure of 5 bar. After 60 minutes, a sample was removed. In it, no more hydrogen sulphide could be detected.

EXAMPLE 8

At a flow rate of 10 l/h, hydrogen sulphide was passed for 18 minutes from a steel tank through a cascade of 4 reactor elements, each of which contained 100 ml of petroleum (quality as in Example 7) and 10.7 g of a 60 % strength solution of iron(III) 2-ethylhexanoate in xylene. A reactor which was situated downstream from this cascade was charged with aqueous zinc acetate solution to find out at which point hydrogen sulphide was no longer absorbed in the reactor cascade. In the downstream reactor which was charged with aqueous zinc acetate solution, a precipitate of zinc sulphide was not observed until all the iron-(III)-2-ethylhexanoate present in the four cascade elements had completely reacted with hydrogen sulphide to form iron sulphide.

What is claimed is:

1. A process for removing hydrogen sulphide from mineral oil-containing liquids comprising contacting said liquid with a solution or dispersion in a hydrocarbon or in a mixture of hydrocarbons of iron 2-ethylhexanoate.

2. A process according to claim 1, in which the hydrogen sulphide is removed from liquids which are to be processed in refineries or petrochemical plants or have been produced there.

3. A process according to claim 1, in which 1.1 to 5 times the amount by weight of the transition metal carboxylate is used which is required by calculation to completely remove the hydrogen sulphide present.

* * * * *